United States Patent [19]

Schmalz

[11] 4,052,684

[45] Oct. 4, 1977

[54] HELICAL RESONATOR

[75] Inventor: Peter Joseph Schmalz, Washington, Pa.

[73] Assignee: RCA Corporation, New York, N.Y.

[21] Appl. No.: 702,401

[22] Filed: July 6, 1976

[51] Int. Cl.[2] ..... H01P 7/00

[52] U.S. Cl. ..... 333/82 R; 333/82 B

[58] Field of Search ..... 333/70 S, 73 R, 82 B, 333/83 R

[56] References Cited

U.S. PATENT DOCUMENTS

| | | | |
|---|---|---|---|
| 2,780,727 | 2/1957 | Dreyer, Jr. | 333/82 B |
| 3,247,475 | 4/1966 | Buetow et al. | 333/83 R |

*Primary Examiner*—Paul L. Gensler

*Attorney, Agent, or Firm*—Edward J. Norton; Robert L. Troike

[57] ABSTRACT

A helical resonator includes a helical coil within a metal enclosure, with the windings at one end of the coil reduced in diameter and shorted to each other so as to form a cylindrical conductive member. The cylindrical conductive member provides one plate of a variable capacitor the other plate of which is partially formed by one wall of the enclosure which is adjacent to the windings of reduced diameter. A screw extends through the one wall of the enclosure and into the cylindrical member. An adjustment of the screw controls the resonant frequency of the cavity.

2 Claims, 1 Drawing Figure

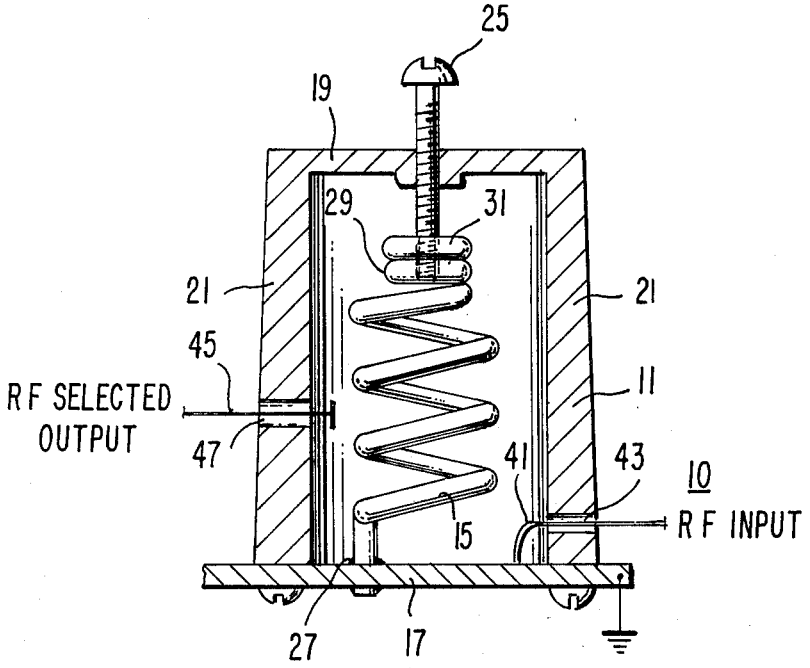
25
19
29
31
21
21
45
11
RF SELECTED
OUTPUT
47
41
43
10
RF INPUT
15
27
17

HELICAL RESONATOR

BACKGROUND OF THE INVENTION

This invention relates to helical resonators which are used as tuning elements to select signals within desired high frequency ranges. Such resonators include inductive elements in the form of a helical coil with the coil in proximity to a surrounding metallic enclosure. The grounded or low impedance end of the coil is directly connected to the metal enclosure. The high impedance opposite end is capacitively coupled to the enclosure. The resonant frequency of the resonator is a function of the physical dimensions of the coil, the capacitive structure and the distance between the high impedance end of the coil and the enclosure. In order to adjust the resonant frequency of the resonator, some prior art helical resonators have included a member such as a screw which is in electrical contact with the enclosure and which can be moved with respect to the high impedance end of the helical coil to thereby vary the equivalent capacitance of the composite structure.

In the prior art helical resonators, the structure has been found to be either inadequate and sometimes expensive for some applications. In one embodiment, a helical coil is wound around and supported by a ceramic form. The combination of the form and the coil is positioned in a metallic enclosure. One plate of a variable tuning capacitor thereof is comprised of an annular element, the position of which is adjustable with respect to the high impedance end of a coil by means of a threaded shaft in engagement with the enclosure. The other plate of this capacitor is comprised of a metal tab which is soldered to the high impedance end of the coil. This tab provides sufficient capacitive coupling between the coil and the annular element so that movement of the annular element can produce an appreciable change in the resonant frequency of the structure. However, when subjected to mechanical vibrations as may occur in a mobile receiver, the coil of this type of resonator has a tendency to vibrate like a coil spring about the ceramic form. This vibration produces corresponding changes in the inductance which undesirably modulate the radio frequency electrical signals passing therethrough. Further, the physical dimensions of the coil change in response to temperature variations tending to detune the resonator. Furthermore, the electrical connection between the tab and the high impedance end of the coil produce an electrical discontinuity in the coil thereby increasing insertion loss of the resonator. Although vibration problems and changes in dimension with temperature have been overcome by a ceramic coil form with grooves corresponding to the turns of the helical coil and the turns cemented to the form, the resulting resonator is relatively expensive and complex.

An attempt to reduce the cost of the resonators is described in U.S. Pat. No. 3,621,484 by D. L. Shult. In this arrangement, a helical resonator is comprised of a conductive housing which surrounds a coil mounted in a plastic form that has been injected molded thereabout. The coils imbedded in the plastic form prevent vibration of the coil. The windings at one end of the coil have a reduced diameter with respect to the rest of the diameter. The other end of the coil is grounded to a portion of the conductive housing. The wall adjacent the windings of reduced diameter form with the windings what is referred to as an equivalent capacitor. A tuning screw is passed through this wall into the hollow area enclosed by the windings of reduced diameter. Adjustment of the screw varies the resonant frequency of the helical resonator. Although this structure produces a low cost resonator, the Q (quality factor of reactive elements lowered by the resistance) of the resonator is diminished when tuning over a broad range of frequencies. When turning with the screw which passes through the windings as when tuning over a large tuning range, the screw causes a shorted turn effect which therefore loads the coil and causes a lowering of the Q. In mobile applications or in other such applications where the bandwidth is narrow, it is highly desirable that Q remain high. Therefore, a relatively inexpensive electrical resonator for applications where it is desired to maintain a high Q resonant circuit over a large tuning range, is in demand.

SUMMARY OF THE INVENTION

Briefly, a helical resonator for processing RF signals within a given range of frequencies and adapted to be tuned is provided by a helical coil of conductive windings mounted at one end within a conductive enclosure with the coil extending from the one end toward an opposite wall of the enclosure. A cylindrical conductive member is connected to the end of the coil nearest to the opposite wall to form one plate of a capacitor with the opposite plate provided by the opposite wall of the enclosure. A moveable conductive means extends from the opposite wall of the enclosure towards the conductive member. This conductive means is adjustable to vary the capacitance of the capacitor formed between the cylindrical conductive member and the opposite conductive wall of the enclosure.

DESCRIPTION OF THE DRAWINGS

A more detailed description follows in conjunction with the drawing wherein the single FIGURE is a cross-sectional view of the enclosure, enclosing the coil and couplers, for an RF circuit or preselector utilizing an electrical resonator according to one embodiment of the invention.

DESCRIPTION OF THE PREFERRED EMBODIMENT

Referring to the FIGURE, there is illustrated a cross-section of an RF coupling circuit 10 which may be utilized, for instance, to preselect signals within a predetermined frequency band passing therethrough from an antenna to the first RF amplifier stage of a receiver by reducing the amplitude of all RF signals outside the desired pass band. The coupling circuit includes a metal enclosure or conductive cavity 11 and a coil 15 mounted within the enclosure 11. The coil 15 is connected to and extends from the bottom wall 17, which is grounded, toward top wall 19. The coil 15 is coaxially centered within the enclosure 11 with the coil spaced from the cylindrical side wall 21 which surround the coil 15. The coil 15, for example, is made with 14 gauge copper. The coil 15 makes four turns of 0.5 inch diameter from point 27 to point 29. The coil continues for one and three quarter turns from point 29 to the end at a reduced turn diameter of about 5/16 of an inch. The reduced diameter turns are adjacent to each other so as to be shorted and may even be soldered to each other. The reduced diameter section 31 between point 29 and the free end of the coil forms a conductive cylindrical member which is one plate of a capacitor. A tuning screw 25 is threaded through the top wall 19 of the enclosure 11. The other plate of the capacitor is formed by the screw 25 and the top wall 19 of the enclosure 11. Adjustment of the resonance of the cavity formed by the enclosure is provided by the relative position of the tuning screw 25 to the reduced diameter section 31 of the coil 15. Since only the capacity is changed when varying the position of the screw relative to the cylindrical section 31 of the coil 15, (no shorted turns) only the capacitance of the circuit is changed and therefore tuning of the resonator is achieved without lowering the Q of the coil 15. The enclosure 11 has a height of ,1.5 inches and is 0.95 inch in diameter. The above described arrangement is for selecting 480 $MH_z \pm 45$ $MH_z$.

The RF input signals are coupled from an antenna or other resonator via coupling probe 41 passing through aperture 43 in side wall 21. The selected RF signals are coupled via capacitive probe 45 passing through coupling aperture 47 in side wall 21. The selected RF signals are coupled to other resonators or to the first mixer of the receiver.

What is claimed is:

1. A helical resonator comprising:

a conductive enclosure, a helical coil of conductive windings mounted at one end to one wall of said enclosure and extending toward an opposite wall of said enclosure, a cylindrical conductive member formed at the free end of said coil and forming with said opposite wall a capacitor, said conductive member having a substantially reduced outside diameter with respect to the turn diameter of the coil, and moveable conductive means electrically connected to and extending from said opposite wall of said enclosure into said cylindrical conductive member, said moveable conductive means being adjustable to vary the capacitance of said capacitor.

2. The combination of claim 1 wherein said conductive member is formed from an extension of the free end of said helical coil with said coil turns at the free end being of reduced diameter with the turns shorted.

* * * * *